US007468117B2

(12) United States Patent
Blodgett et al.

(10) Patent No.: US 7,468,117 B2
(45) Date of Patent: Dec. 23, 2008

(54) METHOD OF TRANSFERRING A WET TISSUE WEB TO A THREE-DIMENSIONAL FABRIC

(75) Inventors: Craig A. Blodgett, Neenah, WI (US); Paul D. Beuther, Neenah, WI (US)

(73) Assignee: Kimberly-Clark Worldwide, Inc.

( * ) Notice: Subject to any disclaimer, the term of this patent is extended or adjusted under 35 U.S.C. 154(b) by 648 days.

(21) Appl. No.: 11/118,611

(22) Filed: Apr. 29, 2005

(65) Prior Publication Data

US 2006/0243408 A1 Nov. 2, 2006

(51) Int. Cl.
*D21F 11/00* (2006.01)

(52) U.S. Cl. ..... 162/193; 162/207; 162/208; 162/199; 34/397

(58) Field of Classification Search ..... 162/193, 162/202–208, 111, 217, 199; 34/397, 406–412, 34/512; 226/5, 7, 91–93, 97.1–97.4
See application file for complete search history.

(56) References Cited

U.S. PATENT DOCUMENTS

| | | | | | |
|---|---|---|---|---|---|
| 3,017,317 | A * | 1/1962 | Voigtman et al. | ..... | 162/111 |
| 3,432,936 | A | 3/1969 | Cole et al. | | |
| 3,639,207 | A * | 2/1972 | Genz et al. | ..... | 162/146 |
| 3,822,182 | A * | 7/1974 | Heysel et al. | ..... | 162/207 |
| 4,361,466 | A * | 11/1982 | Wong et al. | ..... | 162/207 |
| 4,849,054 | A | 7/1989 | Klowak | | |
| 5,240,563 | A * | 8/1993 | Karvinen et al. | ..... | 162/274 |
| 5,256,257 | A | 10/1993 | Schiel | | |
| 5,298,124 | A | 3/1994 | Eklund et al. | | |
| 5,393,383 | A * | 2/1995 | Karvinen et al. | ..... | 162/274 |
| 5,411,636 | A | 5/1995 | Hermans et al. | | |
| 5,611,892 | A | 3/1997 | Karvinen et al. | | |
| 5,690,788 | A | 11/1997 | Marinack et al. | | |
| 5,851,353 | A | 12/1998 | Fiscus et al. | | |
| 5,865,955 | A | 2/1999 | Ilvespää et al. | | |
| 5,968,590 | A | 10/1999 | Ahonen et al. | | |
| 6,001,421 | A | 12/1999 | Ahonen et al. | | |
| 6,004,430 | A * | 12/1999 | Ilvespaa et al. | ..... | 162/207 |
| 6,119,362 | A | 9/2000 | Sundqvist | | |
| 6,287,426 | B1 | 9/2001 | Edwards et al. | | |
| 6,432,267 | B1 | 8/2002 | Watson | | |
| 6,497,792 | B2 * | 12/2002 | Chau Huu et al. | ..... | 162/359.1 |
| 6,547,924 | B2 | 4/2003 | Klerelid et al. | | |
| 6,701,637 | B2 | 3/2004 | Lindsay et al. | | |
| 7,186,317 | B2 * | 3/2007 | Beuther et al. | ..... | 162/109 |
| 2003/0000673 | A1 * | 1/2003 | Anderson | ..... | 162/207 |
| 2006/0243408 | A1 * | 11/2006 | Blodgett et al. | ..... | 162/193 |

FOREIGN PATENT DOCUMENTS

| | | | |
|---|---|---|---|
| DE | 4102356 | C1 * | 1/1992 |
| EP | 0276202 | A2 | 7/1988 |
| EP | 0276202 | A3 | 7/1988 |
| EP | 548038 | A1 * | 6/1993 |
| WO | WO 0014330 | A1 * | 3/2000 |
| WO | WO 2004033793 | A2 | 4/2004 |
| WO | WO 2004033793 | A3 | 4/2004 |
| WO | WO 2006118624 | A1 * | 9/2006 |

OTHER PUBLICATIONS

Search Report and Written Opinion for PCT/US2006/002946, Jul. 27, 2006.

* cited by examiner

*Primary Examiner*—José A Fortuna
(74) *Attorney, Agent, or Firm*—Dority & Manning, P.A.

(57) ABSTRACT

A process for producing tissue webs is disclosed. In particular, the process is directed to transferring a wet web from a transfer surface to a separate conveyor, such as a fabric. The process, in one embodiment, may include the steps of partially dewatering a tissue web, subjecting the web to at least one deflection against a fabric, such as a coarse fabric, and then creping the web. During the process, after being dewatered, the tissue web is transferred from a transfer surface to the fabric while subjecting the wet tissue web to temperatures and pressures sufficient to cause gases to evolve from liquids associated with the web. The gases form in between the tissue web and the transfer surface facilitating transfer of the web onto the fabric. In one particular embodiment, for example, gases are evolved by heating the wet web and then subjecting the web to a suction force. The gases that are evolved from the liquid include gases that were dissolved in the liquid and may include vapors that are also formed during the process, such as water vapor.

40 Claims, 3 Drawing Sheets

METHOD OF TRANSFERRING A WET TISSUE WEB TO A THREE-DIMENSIONAL FABRIC

BACKGROUND OF THE INVENTION

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web. Water is typically removed from the web by mechanically pressing water out of the web which is referred to as "wet-pressing". Although wet-pressing is an effective dewatering process, during the process the tissue web is compressed causing a marked reduction in the caliper of the web and in the bulk of the web.

For most applications, however, it is desirable to provide the final product with as much bulk as possible without compromising other product attributes. Thus, those skilled in the art have devised various processes and techniques in order to increase the bulk of wet laid webs. For example, creping is often used to disrupt paper bonds and increase the bulk of tissue webs. During a creping process, a tissue web is adhered to a heated cylinder and then creped from the cylinder using a creping blade.

As an alternative to wet-pressing processes, through-drying processes have developed in which web compression is avoided as much as possible in order to preserve and enhance the bulk of the web. These processes provide for supporting the web on a coarse mesh fabric while heated air is passed through the web to remove moisture and dry the web.

Although through-dried tissue products exhibit good bulk and softness properties, through-drying tissue machines are expensive to build and operate. Accordingly, a need exists for producing higher quality tissue products by modifying existing, conventional, wet-pressing tissue machines.

In this regard, U.S. Pat. No. 5,411,636 to Hermans, et al., which is incorporated herein by reference, discloses a process for improving the internal bulk of a tissue web by first dewatering a web and then subjecting the tissue web to differential pressure while supported on a coarse fabric at a consistency of about 30% or greater. The processes disclosed in the '636 patent provide various advantages in the art of tissue making.

Additional improvements in the art, however, are still needed. For instance, after the web is dewatered, the web is typically transferred from a felt onto a fabric using air pressure, such as a suction force. When transferring tissue webs having a relatively low basis weight, problems have been encountered in successfully transferring the web from the felt onto the fabric. Due to the fact that the tissue web is wet and that the felt is often a smoother surface than the fabric, the wet tissue web has a tendency to want to remain on the felt causing problems in attempting to transfer the web to the fabric.

In view of the above, a need currently exists for an improved method for producing tissue webs that couples wet-pressing with molding to create a low-density tissue product. In particular, a need exists for an improved method for transferring a wet tissue web from a transfer conveyor to a coarse fabric.

SUMMARY OF THE INVENTION

The present disclosure is generally directed to further improvements in the art of tissue making. In particular, a method is disclosed for transferring a wet web from a transfer conveyor to a fabric during the production of a tissue web.

For example, in one embodiment, the present invention is directed to a method of producing tissue products comprising the steps of first depositing an aqueous suspension of papermaking fibers onto a forming fabric to form a wet web. The wet web may be, for instance, dewatered to a consistency of at least about 30%, such as from about 30% to about 70%. The web can be dewatered using various techniques. In one particular embodiment, for instance, the web may be fed through a press nip and dewatered.

After being dewatered, the web is conveyed on a transfer surface. In one embodiment, for instance, the transfer surface may be substantially liquid impermeable. The transfer surface may comprise, for instance, a felt, a coated fabric, a metal belt optionally containing a pattern of grooves, or a resin coated fabric. In another embodiment, the transfer surface may comprise the surface of a roll that may have a relatively smooth surface or may optionally contain a pattern of grooves. The surface of the roll may comprise any suitable material. For instance, the roll may have a metal surface, a ceramic surface or a stone surface such as a granite surface.

From the transfer surface, the web is transferred to a fabric and may be deflected against the fabric for molding the web and increasing the bulk of the web. In accordance with the present invention, the wet web is subjected to temperatures and pressures sufficient to cause the evolution of a gas from the water associated with the wet web. The gas, for instance, may comprise oxygen or air that was entrained in the water. The gas may also comprise water vapor. The gas facilitates separation of the web from the transfer surface for transfer onto the fabric. For instance, in one embodiment, sufficient amounts of gas may be produced so as to separate at least certain areas of the web from the transfer surface.

In one embodiment, gases are evolved from the water associated with the web by heating the web and also subjecting the web to a suction force. For example, prior to transfer to the fabric, the web may be heated so as to increase the temperature of the web by at least about 2° F., such as at least about 5° F., such as at least about 10° F., and, in one embodiment, by at least about 15° F. Any suitable heating device may be used to heat the web. For instance, the heating device may comprise an electric heater, a gas heater, or a heater that emits microwaves. In one particular embodiment, the heating device comprises an infrared heater. Infrared heaters are particularly well suited for use in the present invention since infrared rays pass through a web and can heat the interface between the web and a conveyor. In fact, in some embodiments, the interface between the web and the conveyor is heated to a greater extent than the bulk of the web.

The suction force as described above may be applied to the web as the web is being transferred to the fabric. The suction force, for instance, may be at a vacuum level at least about 10 inches Hg, such as at least about 15 inches Hg, such as, in one embodiment, at least about 20 inches Hg. Heat in addition to vacuum levels not only cause at least a portion of the water associated with the web to vaporize, but also causes gases dissolved in the water to be released.

In order to maximize the amount of gas that is released from the water associated with the web, in one embodiment, steps can be taken to ensure that relatively high amounts of gases are dissolved in the water. For instance, the water may contain gases at a concentration of at least about 75 ppm at atmospheric pressure and 30° C. More particularly, the gas is made to be dissolved in the water at a concentration of greater than about 100 ppm, greater than about 120 ppm, or, in one embodiment, at a concentration greater than about 150 ppm.

In one embodiment, the tissue making process of the present invention couples wet-pressing with molding to create tissue products having good bulk and low density characteristics. For example, in one embodiment, from the fabric, the web is then conveyed onto a drying drum and optionally creped from the drum. An adhesive may be applied to the tissue web in order to adhere the web to the drying drum. In addition to facilitating creping of the web, the drying drum dries the web to a final dryness.

In general, any suitable tissue product may be made according to the above process. For instance, a tissue web produced as described above may have a basis weight of from about 10 gsm to about 110 gsm. The process, for instance, is particularly well suited for processing relatively light webs, such as those having a basis weight from about 10 gsm to about 25 gsm. The process may be used, however, to also process higher basis weight webs, such as those having a basis weight of from about 25 gsm to about 80 gsm.

Tissue products that may be made in accordance with the present invention include facial tissues, bath tissues, paper towels, industrial wipers, and the like.

Other features and aspects of the present invention are discussed in greater detail below.

BRIEF DESCRIPTION OF THE DRAWINGS

The following is a detailed description of the present invention including reference to the following figures in which.

Figure 1:
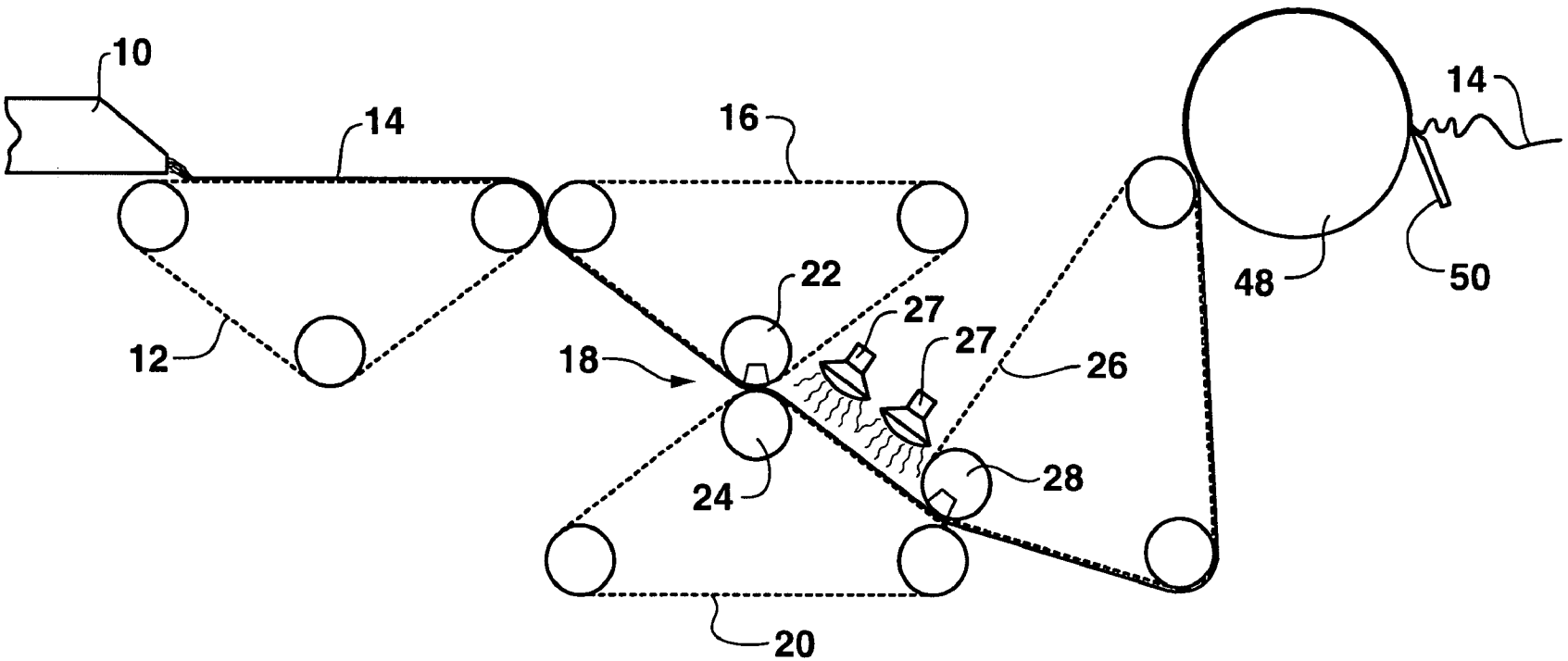
FIG. 1 is a side view of one embodiment of a process made in accordance with the present invention.

Repeat use of reference characters in the present specification and drawings is intended to represent the same or analogous features or elements of the invention.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to the formation of tissue webs having good bulk and softness properties while maintaining adequate strength properties. In general, the tissue webs are made according to a wet-pressing process during which a wet web is transferred from a transfer surface to a fabric, such as a coarse fabric. The method of the present invention facilitates transfer between the transfer surface and the fabric. For instance, in one embodiment, the wet web is heated and/or subjected to a vacuum or suction force that causes gases to evolve from the water associated with the web. The gases may include, for instance, water vapor that is generated or may include dissolved gases that were once entrained in the water. Upon evolution from the water, the gases have a tendency to separate the wet web from the transfer surface allowing for easy movement onto the fabric, even when the tissue web has a relatively low basis weight.

In one particular embodiment, the tissue webs are made by a wet-pressing process in combination with a molding process and a creping process in order to create a high bulk, low-density web. During the process, a wet web is first dewatered, placed on a transfer surface, and is then transferred to a fabric using a pneumatic force. Once on the fabric, the web is deflected against the fabric and, in one embodiment, molded against the fabric. After being deflected, the web is then placed on a drying drum and creped from the drum.

Referring to FIG. 1, one embodiment of a tissue making process in accordance with the present invention is shown. As illustrated, the system includes a head box 10 which deposits an aqueous suspension of papermaking fibers onto a forming fabric 12. The papermaking fibers can include, but are not limited to, all known cellulosic fibers or fiber mixes comprising cellulosic fibers. The fibers can include, for example, hardwood fibers such as eucalyptus fibers or softwood fibers, such as northern softwood kraft fibers. Other fibers may include high-yield fibers, recycled fibers, broke, synthetic cellulosic fibers, and the like.

Once the aqueous suspension of fibers is deposited onto the forming fabric 12, some of the water contained in the aqueous suspension is drained through the fabric and a tissue web 14 is formed. The wet web 14 retained on the surface of the forming fabric has a consistency of about 10%.

As shown in FIG. 1, the wet tissue web 14 is transferred to a dewatering conveyor 16 which may be, for instance, a papermaking felt. The tissue web 14 is then fed into a press nip 18 and further dewatered. The press nip 18 is formed between the dewatering conveyor 16 and a transfer surface, such as a transfer conveyor 20, utilizing a first press roll 22 and a second press roll 24. If desired, one of the press rolls may comprise a vacuum roll to assist in draining fluids from the tissue web 14. For example, as shown in FIG. 1, the first press roll 22 may comprise a vacuum roll for applying a suction force to the web. The press nip dewaters the tissue web 14 to a consistency of about 30% or greater, such as from about 30% to about 70%. In one particular embodiment, for example, the tissue web is dewatered in the nip 18 to a consistency of about 35% to about 50%.

In FIG. 1, a press nip is shown formed between a pair of opposing press rolls. In other embodiments, multiple press nips may be used in order to dewater the web. Further, extended press nips may also be incorporated into the process. The extended press nip, for instance, may contain a stationary shoe positioned opposite a press roll. In this embodiment, the stationary shoe may apply a suction force to the tissue web. In further embodiments, a through-air dryer may be used in order to dewater the web.

From the nip 18, the tissue web 14 is conveyed on the transfer conveyor 20 and then transferred to a fabric 26, such as a coarse or molding fabric. In accordance with the present invention, in order to facilitate transfer of the tissue web 14 from the transfer conveyor 20 to the fabric 26, the system may further include one or more heating devices 27 and a vacuum roll 28. As shown, in this embodiment, the heating devices 27 are positioned upstream from the vacuum roll 28 and the fabric 26. The vacuum roll 28 is positioned where transfer occurs. The vacuum roll 28 applies a pneumatic force, namely a suction force, against the tissue web 14 to assist in transferring the web onto the fabric. The heating devices 27 and/or the vacuum roll 28 are designed to cause gases to be evolved from the water that is contained or otherwise associated with the wet tissue web 14. The gases then facilitate transfer of the web onto the fabric 26 as will be described in more detail below.

The suction force produced by the vacuum roll 28 may not only assist in transfer of the tissue web but, in some embodiments, may also deflect the web 14 against the fabric 26. As used herein, the term "deflection" refers to a process in which a tissue web is biased against an opposing surface with a force sufficient to cause at least some of the fibers in the web to reorient. In some embodiments, the force may be sufficient to cause the web to mold and conform to the topography of the surface. In accordance with the process, deflection of the web against the fabric may occur against the vacuum roll 28 and/or may occur at other positions along the fabric 26. Further, it should be understood that in addition to a vacuum roll 28, other vacuum devices may be used, such as a stationary vacuum shoe.

In order to create a significant amount of fiber disruption, in one embodiment, the fabric 26 may comprise a coarse fabric. The nature of the coarse fabric is such that the wet web must be supported in some areas and unsupported in others in order to enable the web to flex in response to the differential air pressure or other deflection force applied to the web. Such fabrics suitable for purposes of this invention include, without limitation, those papermaking fabrics which exhibit significant open area or three dimensional surface contour or depressions sufficient to impart substantial z-directional deflection of the web. Such fabrics include single-layer, multi-layer, or composite permeable structures. Preferred fabrics have at least some of the following characteristics: (1) On the side of the fabric that is in contact with the wet web (the top side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the top side, the distance between the highest point of the MD knuckle and the highest point of the CD knuckle is from about 0.001 to about 0.02 or 0.03 inch. In between these two levels, there can be knuckles formed either by MD or CD strands that give the topography a 3-dimensional hill/valley appearance which is imparted to the sheet during the wet molding step; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and (5) The fabric may be made to show certain geometric patterns that are pleasing to the eye, which typically repeat between every 2 to 50 warp yarns. Suitable commercially available coarse fabrics include a number of fabrics made by Asten Johnson, including without limitation Asten 934, 920, 52B, and Velostar V800.

As shown in FIG. 1, after being conveyed on the fabric 26, the tissue web 14, in one embodiment, may optionally be transferred to a drying cylinder 48 in order to dry the web to a final dryness. The drying cylinder 48 may be, for instance, a Yankee dryer.

In one embodiment, an adhesive may be applied to the tissue web or to the dryer for adhering the web to the dryer. The adhesive may be, for instance, any suitable or conventionally used adhesive. For instance, in one embodiment, an adhesive containing polyvinyl alcohol may be used. The adhesive may be, for instance, sprayed onto the web. As shown in FIG. 1, once adhered to the drying cylinder 48, the tissue web 14 is creped from the cylinder using a creping blade 50. Creping the web serves to further cause fiber disruption and increase the bulk of the web. Once creped, the tissue web is wound onto a reel for converting and later packaging.

Although the process in FIG. 1 shows the use of a drying cylinder and creping blade, it should be understood that any suitable drying device may be used in the present invention. For example, in other embodiments, the process may include a through-air dryer.

Referring back to FIG. 2, as described above, after the tissue web 14 is dewatered in the press nip 18, the tissue web is transferred from the transfer surface or conveyor 20 to the fabric 26. As described above, in accordance with the present invention, the wet tissue web 14 is subjected to temperatures and pressures sufficient to cause gases to evolve from the liquids that are associated with the web. The gases form between the wet web and the underlying transfer conveyor 20, which facilitates transfer of the web from the transfer conveyor 20 to the fabric 26. The process of the present invention is particularly well suited to transferring relatively low basis weight tissue webs although the teachings of the present invention may work equally well with any cellulosic web.

The gases that evolve from the liquids associated with the tissue web 14 may vary depending upon the particular application. In one embodiment, for instance, the gases that are evolved from the liquids comprise gases that were dissolved or otherwise entrained within the liquids. These gases may include, for instance, oxygen, air, carbon dioxide and the like. In addition, in some embodiments, the liquids associated with the wet tissue web may at least partially vaporize creating additional gases. For instance, water contained in the web may turn into water vapor which can assist in separating the web from the transfer surface. In particular, the gases that are evolved can form pockets that separate the web from the transfer surface in certain locations.

Any suitable manner of evolving gases from the liquids associated with the wet tissue web 14 may be used in the process of the present invention. In the particular embodiment illustrated in FIGS. 1 and 2, gases are created or evolved by subjecting the tissue web 14 to a combination of heat and vacuum. The combination of heat and vacuum are known not only to promote the formation of vapors such as water vapor, but also are known to lower the solubility of gases in liquids.

Figure 2:
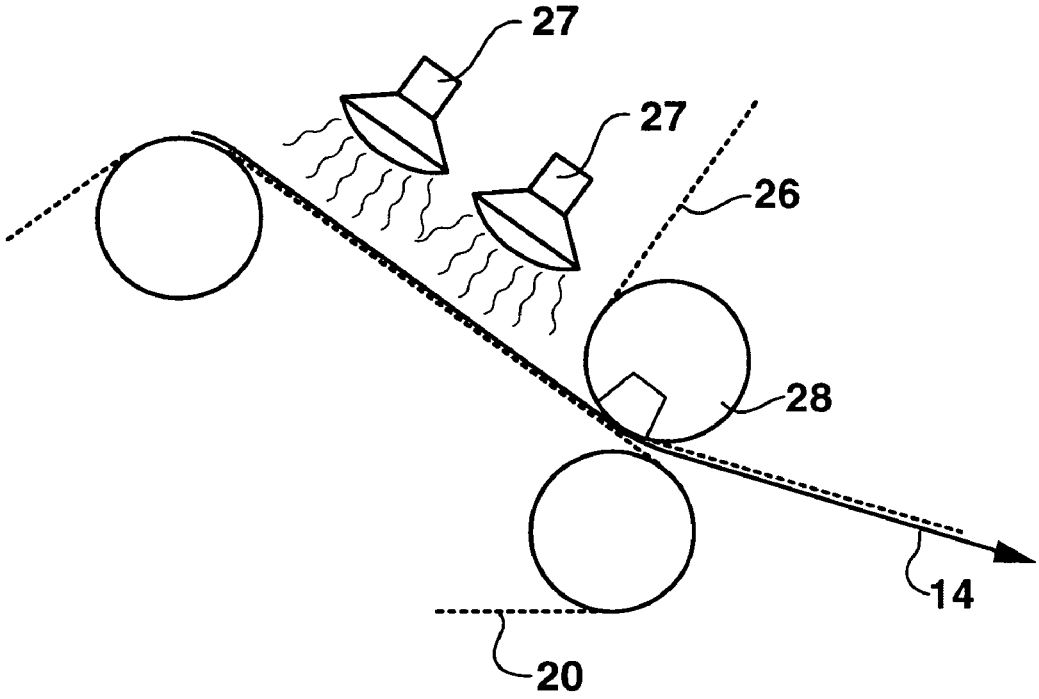
FIG. 2 is a partial exploded side view of the transfer of a tissue web from a transfer conveyor to a fabric as shown in FIG. 1.

As shown particularly in FIG. 2, the papermaking system includes the heating devices 27. In general, any suitable heating device may be used in accordance with the present invention. Examples of heating devices include gas heaters, steam heaters, electric heaters, heaters that heat through induction, heaters that emit microwave radiation, infrared heaters, other types of combustion heaters, mixtures thereof, and the like. In one particular embodiment, for instance, the heating devices 27 comprise infrared heaters. Infrared heaters may provide some advantages in certain applications due to the ability of infrared rays to penetrate wet tissue webs.

The amount the tissue web 14 and any associated liquids increase in temperature due to the heating devices 27 may depend upon the particular application. In general, for instance, the heating devices 27 should be capable of increasing the temperature of the wet web by at least about 1° F., such as at least about 2° F. For instance, the heating devices 27 may be configured to increase the temperature of the wet web by at least 5° F., by at least 10° F., by at least 15° F., and, in one embodiment, by at least 20° F.

The amount of pneumatic pressure that is generated by the vacuum roll 28 as shown in FIG. 2 may also vary depending upon the particular application and the desired result. In general, for instance, the vacuum roll 28 may produce vacuum levels of at least 1 inch Hg, at least 2 inches Hg, such as at least 5 inches Hg. The pressures may vary, for instance, from about 1 inch Hg to about 30 inches Hg, such as from about 5 inches Hg to about 20 inches Hg. In one particular embodiment, for instance, the vacuum level created by the vacuum roll 28 may be from about 10 inches Hg to about 25 inches Hg, such as from about 15 inches Hg to about 20 inches Hg.

As described above, the gases that are evolved from the liquids associated with the tissue web 14 may have a tendency to form between the tissue web 14 and the transfer conveyor 20. In order to maximize the benefit obtained from the gas, in one embodiment, the transfer conveyor 20 may comprise a material that has a relatively low permeability, such as a material that ranges from semi-permeable to impermeable.

The transfer conveyor 20, for instance, may have a permeability of from 0 (impermeable) to about 10 cfm per $ft^2$ measured at 0.5 inch of water pressure. A Frazier air permeability tester may be used in order to determine the air permeability of the transfer conveyor.

In one embodiment, for instance, the transfer conveyor 20 may comprise a relatively low liquid permeable felt. A transfer felt, for instance, can be constructed in various ways from various materials in order to provide the permeability characteristics that are desired. In one embodiment, for instance, the transfer felt may be made from a small capillary material. For example, the felt may contain a woven fabric embedded with small diameter fibers. The small diameter fibers may account for greater than about 40%, such as greater than about 50%, and in one embodiment, may account for greater than about 60% of the mass of the overall felt. The fibers, for example, may have a diameter of about 3 denier or less. Any suitable fiber may be used to construct the felt, such as carded nylon fibers. If desired, the felt and/or the fibers may be treated with a coating that further serves to lower the permeability of the material.

In an alternative embodiment, the transfer conveyor 20 may comprise a substantially impermeable metal belt. Such metal belts, for instance, are disclosed in U.S. Pat. No. 6,701,637, which is incorporated herein by reference. Metal belts are also sold under the name CONDEBELT by Valmet Corporation of Finland.

Metal belts that may be used in accordance with the present invention may have a smooth surface or may have a grooved surface. For instance, grooves can be formed into the belt in the machine direction, in the cross-machine direction, or in any suitable pattern, such as a reticulated pattern. Metal belts can also be coated with various materials if desired. For instance, the metal belt may be coated with a ceramic, a polymer, an inorganic plastic, a glass, a composite material, a cermet, a plasma sprayed diamond, boron nitride, silicon nitride, silicon carbide, fluoropolymers, mixtures thereof, and the like. Suitable polymers that may be coated on the metal belt include polyamides, polyacrylonitrile, polyester, fluorocarbons, melamineformaldehyde, phenolics, sulfone polymers, and mixtures thereof.

In addition to metal belts and felts, in still another embodiment of the present invention, the transfer conveyor 20 may comprise a substantially impermeable texturing belt as disclosed in U.S. Pat. No. 5,298,124 which is also incorporated herein by reference. In one embodiment, for instance, the substantially impermeable texturing belt may include a back layer attached to a coated fabric layer. The fabric layer may be coated with a polymer in order to enclose the threads of the fabric without altering the structure of the fabric. The polymer coated on the fabric, for instance, may have a hardness of 50 to 97 Shore A and may comprise a polymer as those described above. The fabric may, in one embodiment, have a 3-dimensional configuration containing from about 25 to about 150 knuckles/$cm^2$. In other embodiments, however, a substantially smooth fabric may be preferred.

The backing layer attached to the fabric layer may comprise a polymer of the same type coated on the fabric. The polymer may comprise, for instance, an acrylic polymer resin, a polyurethane resin, a polyurethane/polycarbonate resin, and the like.

Figure 3:
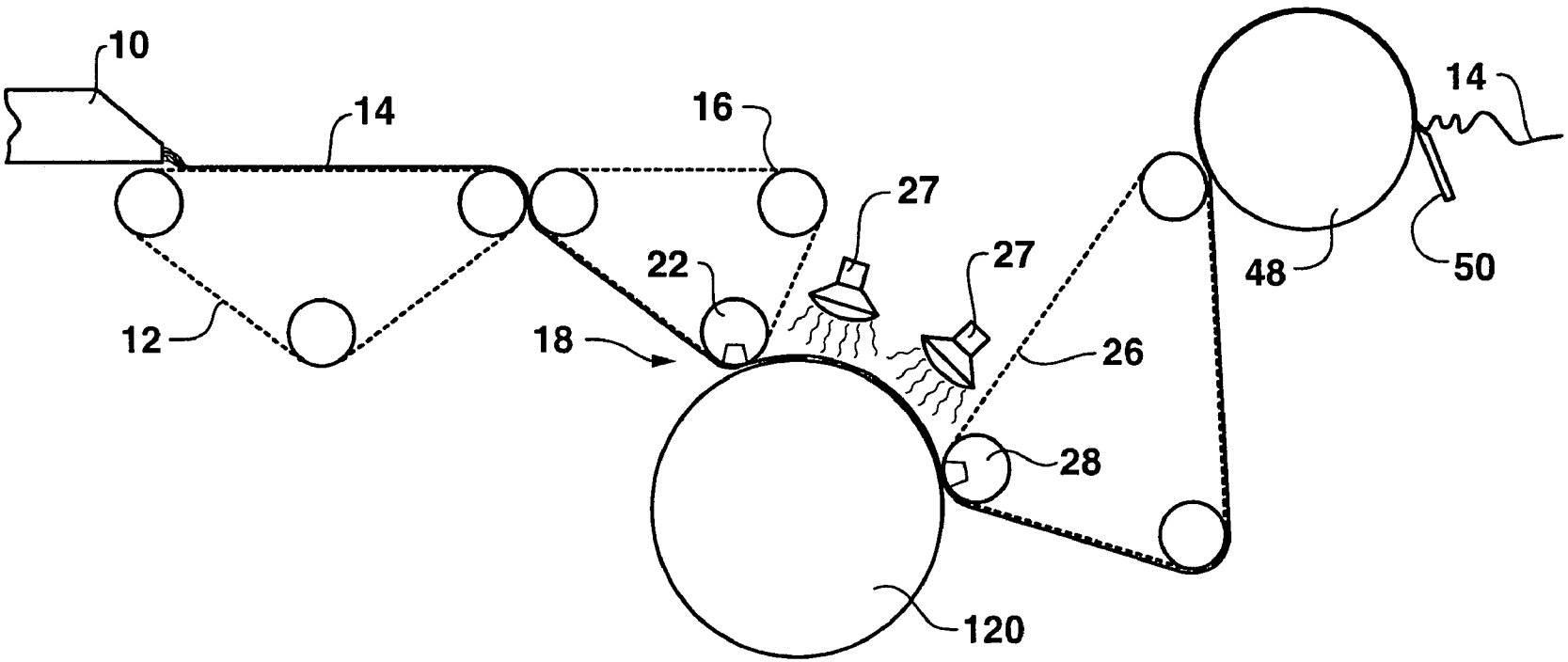
FIG. 3 is a side view of another embodiment of a process made in accordance with the present invention.

Referring to FIG. 3, another embodiment of a papermaking process in accordance with the present invention is illustrated. Like reference numerals have been used to indicate similar elements. As shown, in this embodiment, similar to the embodiment shown in FIG. 1, the process includes a headbox 10 which deposits an aqueous suspension of papermaking fibers onto a forming fabric 12. From the forming fabric 12, the wet web is transferred to a dewatering conveyor 16 and fed into a press nip 18 and further dewatered.

From the dewatering conveyor 16, in this embodiment, the wet web is then transferred to a transfer roll 120 instead of a transfer conveyor as shown in FIG. 1. While on the transfer roll 120, the tissue web 14 is heated and then transferred to a fabric 26 with assistance of a vacuum roll 28. Similar to the previous embodiment, the heating devices 27 in combination with the vacuum roll 28 serve to evolve gases from the liquid associated with the web which assists in transferring the web from the transfer roll 120 to the fabric 26. From the fabric 26, the tissue web 14 is then placed against a creping drum 48 and creped from the drum using a creping blade 50.

The transfer roll 120 can be substantially liquid impermeable and may have, for instance, a metal surface. The surface may also include a coating, such as a polymer coating, a ceramic coating, a glass coating, and the like.

When using a transfer roll 120 as shown in FIG. 3, in addition to or instead of using the heating devices 27, the transfer roll 120 itself may be heated from the inside for increasing the temperature of the wet web.

During the process of the present invention, the amount of gas that is evolved from the liquids associated with the tissue web 14 will vary depending upon numerous factors. The amount of gas that is produced will depend, for instance, on the amount the tissue web is heated and/or on the vacuum level to which the web is exposed. Other factors include the initial starting temperature of the web and the amount of gas that is dissolved in the liquids associated with the web.

In one embodiment, in order to increase the amount of gas that is evolved during the process, greater amounts of gases may be entrained or dissolved within the liquids that are associated with the web. For instance, during formation of the aqueous suspension of fibers that is used to form the web, the aqueous suspension is typically subjected to turbulent flow conditions causing relatively high amounts of air to dissolve in the liquid. Once the aqueous suspension of fibers is formed, the aqueous suspension is then sent through a fan pump to a white water tray prior to being introduced into the headbox. Gases tend to escape from the aqueous suspension the longer the suspension remains in the white water tray. Thus, in order to increase the amount of gases contained in the liquid associated with the fibers, the amount of time the aqueous suspension remains in the white water tray may be reduced.

The concentration of gases contained within the aqueous suspension of fibers as the aqueous suspension is placed on the forming surface may be at least about 75 ppm, such as at least about 100 ppm, such as at least about 125 ppm. In one particular embodiment, for instance, the concentration of gases contained within the aqueous suspension may be greater than about 150 ppm.

In one embodiment, steps can be taken to actively incorporate greater amounts of gases in the aqueous suspension of fibers. For instance, in one embodiment, the aqueous suspension of fibers may be aerated prior to contact with the forming surface. In an alternative embodiment, a gas, such as carbon dioxide, may also be incorporated into the aqueous suspension.

It should be understood that the embodiments illustrated in FIGS. 1 and 3 merely represent two configurations of tissue making processes in accordance with the present invention. It should be understood that the process may include many more conveyors that comprise fabrics or felts as the tissue web is being formed. In fact, the dewatering of the web may occur upstream from the transfer conveyor 20.

The process of the present invention is particularly well suited to producing all different types of tissue products. The tissue products can have, for instance, a basis weight of from about 6 gsm to about 120 gsm. Tissue products that may be produced according to the present invention include paper towels, industrial wipers, and various products.

In one particular embodiment of the present invention, the process is used to produce facial tissue or bath tissue. The facial tissue webs or bath tissue webs can have a basis weight, for instance, of from about 6 gsm to about 45 gsm, such as from about 10 gsm to about 25 gsm. The final product can contain a single ply or can contain multiple plies (2 to 3 plies).

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A method of producing a tissue product comprising:

entraining a gas in an aqueous suspension of papermaking fibers to a concentration of at least about 75 ppm;

depositing the aqueous suspension of papermaking fibers onto a forming fabric to form a wet web;

dewatering the wet web to a consistency of at least about 30%;

conveying the dewatered web onto a transfer surface, wherein the transfer surface has a permeability of from 0 to about 10 cfm per $ft^2$ measured at 0.5 inch of water pressure;

heating the web on the transfer surface;

transferring the web from the transfer surface to a fabric while applying a suction force to the web; and wherein the step of heating the web in addition to the suction force causing the gas to evolve from the water associated with the web, the gas facilitating separation of the web from the transfer surface for transfer onto the fabric.

2. A method as defined in claim 1, wherein the transfer surface comprises a metal belt.

3. A method as defined in claim 2, wherein the metal belt defines grooves in the transfer surface.

4. A method as defined in claim 1, wherein the transfer surface comprises a coated fabric.

5. A method as in claim 1, wherein the transfer surface is substantially water impermeable.

6. A method as defined in claim 1, wherein the transfer surface comprises a roll.

7. A method as defined in claim 1, wherein the transfer surface comprises a water semi-permeable felt.

8. A method as defined in claim 1, wherein the suction force applied to the web creates a vacuum level of at least 10 inches of Hg.

9. A method as defined in claim 1, wherein the suction force applied to the web creates a vacuum level of at least 20 inches of Hg.

10. A method as defined in claim 1, wherein the web is heated by a heating device, the heating device comprising an infrared heating device.

11. A method as defined in claim 1, wherein the web is heated by a heating device, the heating device comprising a microwave device, an electric heater, a steam heater or a gas heater.

12. A method as defined in claim 1, further comprising the step of conveying the web onto a drying drum after the web is transferred to the fabric and creping the web from the drum.

13. A method as defined in claim 1, wherein the wet web is dewatered by being passed through a press nip.

14. A method as defined in claim 1, wherein the final dried web has a basis weight of from about 10 to about 30 gsm.

15. A method as defined in claim 1, wherein the final dried web has a basis weight of from about 30 to about 80 gsm.

16. A method as defined in claim 1, wherein the suction force applied to the web deflects the web against the fabric.

17. A method as defined in claim 1, wherein the gas that is evolved from the water associated with the web comprises oxygen.

18. A method as defined in claim 1, wherein the gas that is evolved from the water associated with the web comprises water vapor.

19. A method as defined in claim 1, wherein the gas that is evolved from the water associated with the web comprises carbon dioxide.

20. A method as defined in claim 1, wherein a sufficient amount of gas is evolved so as to, in at least one area, separate the web from the transfer surface.

21. A method as defined in claim 1, wherein the web is heated in an amount sufficient to increase the temperature of the web by at least 1° F.

22. A method as defined in claim 1, wherein the web is heated in an amount sufficient to increase the temperature of the web by at least 10° F.

23. A method as defined in claim 1, wherein the concentration of entrained gas in the aqueous suspension of papermaking fibers is at least about 100 ppm.

24. A method as defined in claim 1, wherein the concentration of entrained gas in the aqueous suspension of papermaking fibers is at least about 150 ppm.

25. A method as in claim 1, wherein entraining a gas in an aqueous suspension of papermaking fibers comprises aerating the aqueous suspension of fibers.

26. A method of producing a tissue product comprising:

entraining a gas in an aqueous suspension of papermaking fibers to a concentration of at least about 75 ppm;

depositing the aqueous suspension of papermaking fibers onto a forming fabric to form a wet web, water associated with the web containing a dissolved gas;

conveying the wet web onto a transfer surface, the transfer surface being substantially water impermeable, wherein the transfer surface has a permeability of from 0 to about 10 cfm per $ft^2$ measured at 0.5 inch of water pressure;

subjecting the web to temperatures and pressures sufficient to cause gases dissolved within the water to undissolve and evolve from the water;

transferring the web from the transfer surface to a fabric, the gases that have evolved from the water facilitating separation of the web from the transfer surface for transfer onto the fabric.

27. A method as defined in claim 26, wherein the concentration of entrained gas in the aqueous suspension of papermaking fibers is at least about 125 ppm.

28. A method as defined in claim 26, wherein the wet web is heated and subjected to a suction force in order to cause gases contained in the water to evolve.

29. A method as defined in claim 28, wherein the web is heated so as to increase the temperature of the web by at least 2° F. and wherein the suction force has a vacuum level of at least about 10 inches Hg.

30. A method as defined in claim 29, wherein the wet web is heated so as to increase the temperature of the web by at least 10° F.

31. A method as defined in claim 29, wherein the suction force is at a vacuum level of at least about 20 inches Hg.

32. A method as defined in claim 28, wherein the wet web is heated using an infrared heater.

33. A method as defined in claim 26, wherein the final dried web has a basis weight of from about 10 to about 30 gsm.

34. A method as defined in claim 26, wherein the transfer surface comprises a roll.

35. A method as defined in claim 26, wherein the transfer surface comprises a metal belt or a coated fabric.

36. A method as defined in claim 26, wherein the water associated with the web has air dissolved within the water at a concentration of at least about 100 ppm.

37. A method as defined in claim 26, wherein the gas that is evolved from the water associated with the web comprises oxygen, water vapor, or mixtures thereof.

38. A method as defined in claim 26, further comprising the step of conveying the web onto a drying drum and creping the web from the drum.

39. A method as defined in claim 26, wherein the concentration of entrained gas in the aqueous suspension of papermaking fibers is at least about 150 ppm.

40. A method as in claim 26, wherein entraining a gas in an aqueous suspension of papermaking fibers comprises aerating the aqueous suspension of fibers.

* * * * *